United States Patent [19]

Long

[11] 4,039,095

[45] Aug. 2, 1977

[54] SWING MECHANISM FOR BACKHOE

[75] Inventor: Elton B. Long, Burlington, Iowa

[73] Assignee: J. I. Case Company, Racine, Wis.

[21] Appl. No.: 659,170

[22] Filed: Feb. 18, 1976

Related U.S. Application Data

[63] Continuation-in-part of Ser. No. 556,588, March 10, 1975, abandoned.

[51] Int. Cl.[2] ..... E02F 3/32

[52] U.S. Cl. ..... 214/138 D; 214/138 C

[58] Field of Search ..... 214/138 R, 138 C, 138 D

[56] References Cited

U.S. PATENT DOCUMENTS

| | | | |
|---|---|---|---|
| 3,047,171 | 7/1962 | Long | 214/138 D |
| 3,250,410 | 5/1966 | Dorkins | 214/138 C |
| 3,343,686 | 9/1967 | Bjerkon | 214/138 D |
| 3,494,636 | 2/1970 | Magee | 214/138 C |

*Primary Examiner*—Robert J. Spar
*Assistant Examiner*—Ross Weaver
*Attorney, Agent, or Firm*—Dressler, Goldsmith, Clement, Gordon & Shore, Ltd.

[57] ABSTRACT

An earthworking implement that is pivotally supported on a swing tower which is connected to a frame that is transversely shiftable with respect to the vehicle is disclosed herein. The swing tower is pivoted on the frame by a pair of vertically spaced double acting fluid rams that include cylinders and piston rods with the cylinders being pivoted about a common vertical pivot that is located on the forward end of the frame so that the entire cylinder structure is located within the frame confines.

3 Claims, 4 Drawing Figures

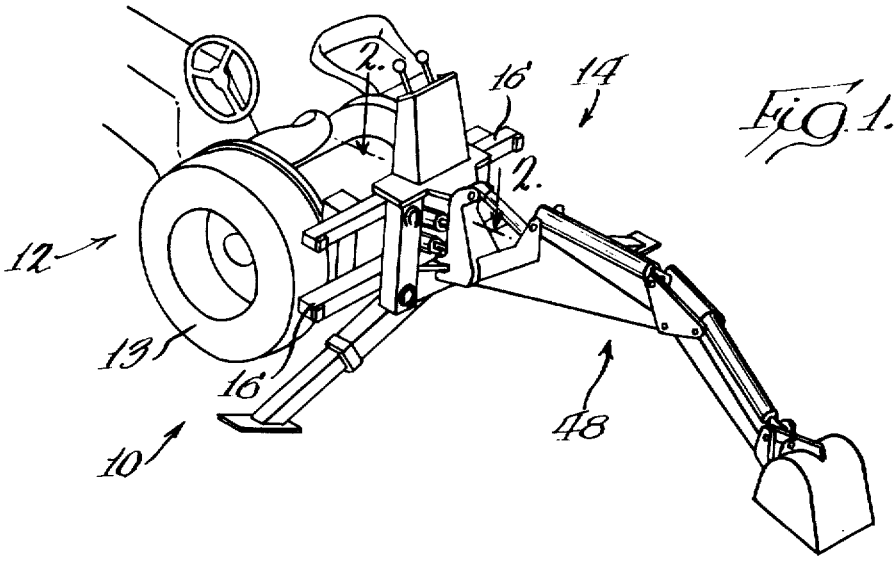
Fig. 1.
Fig. 2.
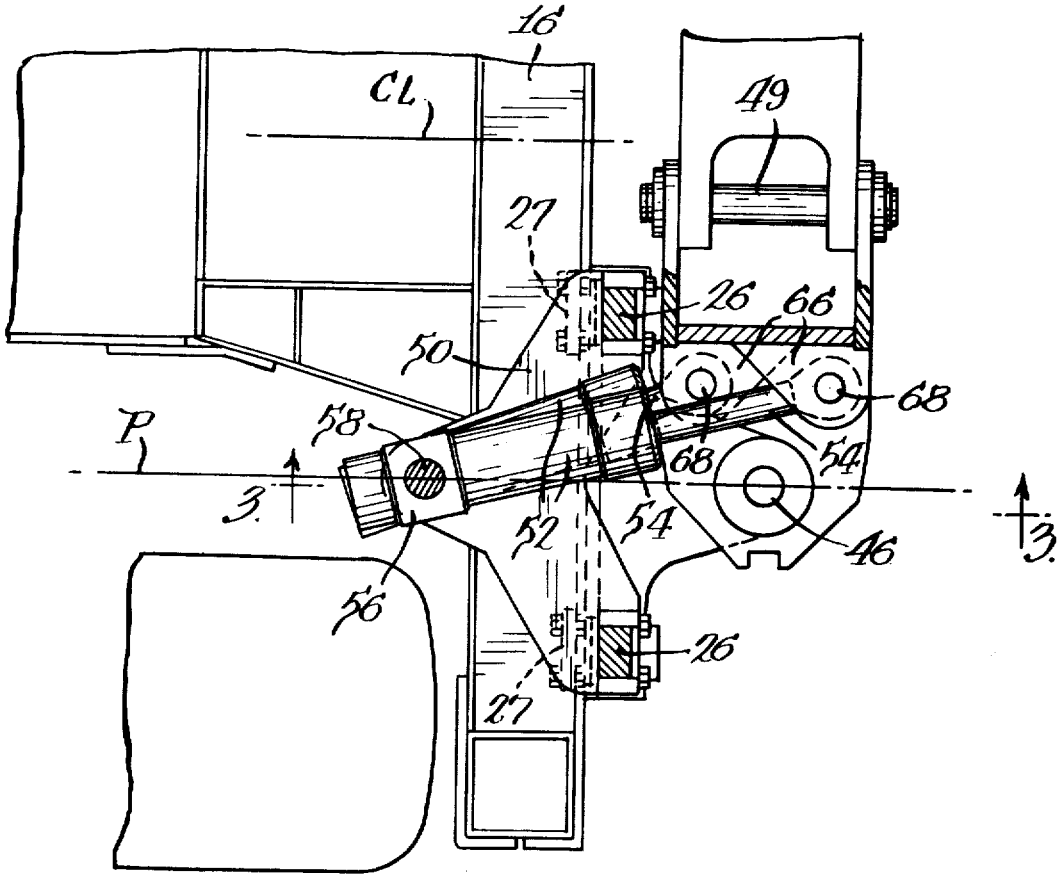

SWING MECHANISM FOR BACKHOE

REFERENCE TO RELATED APPLICATION

This application is a continuation-in-part of application Ser. No. 556,588, filed Mar. 10, 1975, now abandoned.

BACKGROUND OF THE INVENTION

The present invention relates to earthworking implements such as backhoes of the type disclosed in Long U.S. Pat. No. 3,047,171.

For many years now it has been common to mount the backhoe support structure or swing tower on a frame and utilize a pair of hydraulic fluid rams for pivoting the tower with respect to the frame. In such a unit, the hydraulic cylinders are usually connected to the boom support or swing tower on opposite sides of the vertical pivot axis between the swing tower and the frame.

For example, in the above mentioned Long patent, the free ends of the piston rods of the fluid rams are connected to the frame structure at spaced locations while the cylinders of the fluid rams are connected at transversely spaced points to the swing tower or mast.

In recent years, an earthworking implement of the type disclosed in the Long patent has also been mounted in a manner that the entire unit can be shifted transversely with respect to the vehicle. An example of such unit is shown in U.S. Pat. No. 3,434,099. In this patent, the frame supporting the mast or tower is supported on transversely extending rails that are secured to the rear end of the vehicle. This allows the operator to position the frame in any one of an infinite number of positions with respect to the fixed rails and readily lock the unit with respect to the rails.

One of the problems encountered with a transversely shiftable unit of the type discussed above, is the limit of transverse shifting of the earthworking implement with respect to the vehicle. The length of the transversely extending rail is of necessity limited to the width of the vehicle so that the opposite ends of the rails do not extend beyond the outer edges of the rear wheels. Thus, in order to allow for sufficient transverse shifting of the earthworking unit, it has been proposed to mount all of the frame structure as well as the fluid rams rearwardly of the wheels of the vehicle to allow sufficient space so that the unit can be shifted transversely the desired amount. Such a proposed unit thus is capable of being shifted transversely a sufficient distance so that an operator can move the backhoe unit in alignment with the rear wheels and the implement can be used to dig directly adjacent a wall. However, such a unit has the disadvantage of having the center of gravity of the unit located substantially rearwardly of the rear axle for the vehicle. This present substantial problems, particularly when the unit is being transported since the vehicle experiences a great deal of bouncing because of the substantial moment arm for the implement with respect to the rear axle of the vehicle.

Another proposal for mounting a backhoe on a vehicle so that a trench can be dug parallel to an obstruction, such as a building, is proposed in U.S. Pat. No. 3,250,410. This patent incorporates a complicated supporting structure for the frame that supports the backhoe and only one of the two fluid rams is utilized for swinging the unit in a given direction.

SUMMARY OF THE INVENTION

According to the present invention, the backhoe frame and the swing mechanism for the tower are mounted in such a manner that the backhoe frame can be moved generally into alignment with either of the rear wheels while the center of gravity is located closer to the rear axle than has heretofore been possible. Also, the swing tower can be rotated at least 180° without the use of switching valves.

More specifically, the frame for the backhoe, which is slidably supported on transversely extending rails, has a support portion thereof extending between the rails and the support portion extends into the area between the two rear wheels of the vehicle. The two fluid rams which define the swing mechanism for the tower supported on the frame are vertically aligned with each other and are connected to the portion of the frame extending between the rails with the connection being located forwardly of the sliding rail and defining a common pivot for both fluid rams with the pivot being located along a longitudinal plane that passes through the pivot point between the swing tower and the frame.

Both fluid rams are double acting and a single three position valve is used to control the flow of fluid to and from the rams so that both fluid rams can be used for moving the swing tower.

BRIEF DESCRIPTION OF THE SEVERAL VIEWS OF THE DRAWINGS

FIG. 1 shows a fragmentary perspective view of a vehicle having an earthworking implement attached to the rear end thereof;

FIG. 2 is an enlarged fragmentary sectional view, as viewed along line 2—2 of FIG. 1;

DETAILED DESCRIPTION

Figure 4:
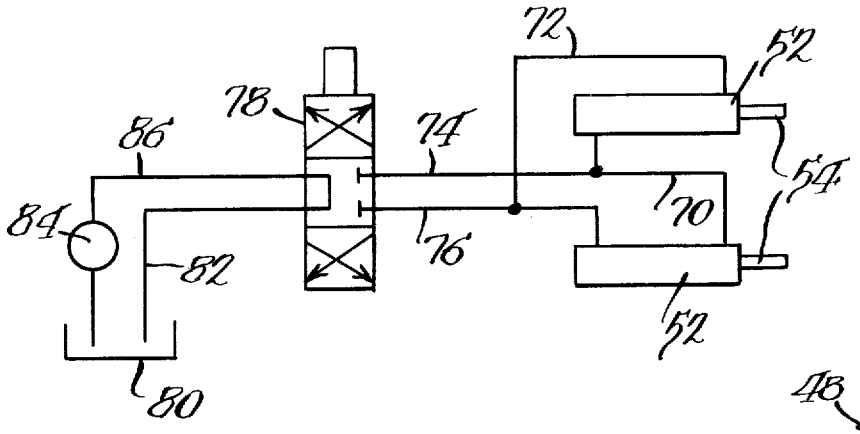
FIG. 4 is a schematic illustration of the hydraulic circuit for the fluid rams.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the invention to the embodiment illustrated.

FIG. 1 of the drawings generally shows an earthworking implement 10 consisting of a vehicle 12 having rear wheels 13 with an earthworking unit 14 secured to the rear end thereof. Vehicle 12 has a pair of horizontally oriented, vertically spaced, elongated support members or rails 16 secured to the rear end thereof. Each of the rails 16 is substantially rectangular in cross section (FIG. 3) and includes a rear vertical plate 18, with the rails releasably connected to vehicle 10 through frame 17. As most clearly shown in FIG. 3, tower frame 20 consists of upper and lower plates 22 and 24 that are interconnected by a pair of vertical beams 26. The transversely spaced vertical beams or columns 26 each have a pair of lock members or means 28 supported thereon for securely locking the frame 20 in any one of a plurality of adjusted positions with respect to rails or support members 16. These lock members or means may be of the type disclosed in U.S. Pat.

No. 3,494,636 or may be hydraulically actuated assemblies well known in the art.

Top and bottom plates 22 and 24 each have a pair of transversely spaced abutments 27 secured thereto by bolts and the abutments engage the forward surfaces of plates 18 while the lower surface of upper plate 22 is supported on the edge of upper plate 18. Thus, the entire frame 20 may be laterally shifted with respect to rails 16 and locked in adjusted positions by lock means 28.

Mobile frame 20 supports a swing tower 40 that has a substantial C-shaped configuration with upper and lower portions 42 and 44 respectively pivotally supported on upper and lower plates 22 and 24 by pivot pins 46. Pivot pins 46 define a vertical tower pivot axis for supporting swing tower 40 for pivotal movement on frame 20. Swing tower 40 supports a backhoe assembly generally designated by reference numerai 48 for pivotal movement about a horizontal pivot 49. Since the backhoe assembly or earthworking unit 48 is well known in the art, no detailed description thereof appears to be necessary.

The swing tower is pivoted with respect to the frame by a pair of fluid rams that are mounted in a unique manner in order to allow the frame to be moved in close proximity to either side of the sliding rails while still having the center of gravity for the backhoe or earthworking implement 48 as close as possible to the rear axle for the vehicle. As most clearly shown in FIGS. 2 and 3, frame structure 20 has a support portion consisting of three plates 50 extending between rails 16 and the plates terminate forwardly of the respective rails. The two fluid rams, which define the swing mechanism for swing tower 40, each include a cylinder 52 and a piston rod 54 that extends from one end of the cylinder. Each of the cylinders has a trunion mounting bracket 56 secured to the body thereof intermediate opposite ends with a pair of trunions 58 carried by the bracket 56. The trunions 58 are respectively received in openings 60 in the respective plates 50 so that the two cylinders are mounted in vertically spaced relation to each other and are located between an adjacent pair of plates 50. Also, the openings 60 are positioned so that both cylinders are supported on a common vertical pivot axis at the forward ends of the respective plates. Because of the location of the pivot axis and plates 50, a single trunion pin can be utilized for mounting the lower part of upper cylinder 52 and the upper part of lower cylinder 52. It will be noted in FIG. 2 that the common pivot axis defined by openings 60 and trunions 58 is located on a plane P which extends through the pivot axis defined by pins 46 and this plane is generally parallel to the longitudinal axis of the tractor and the pivot axis is located forward of rais 16 and between the rear edges of wheels 13.

Figure 3:
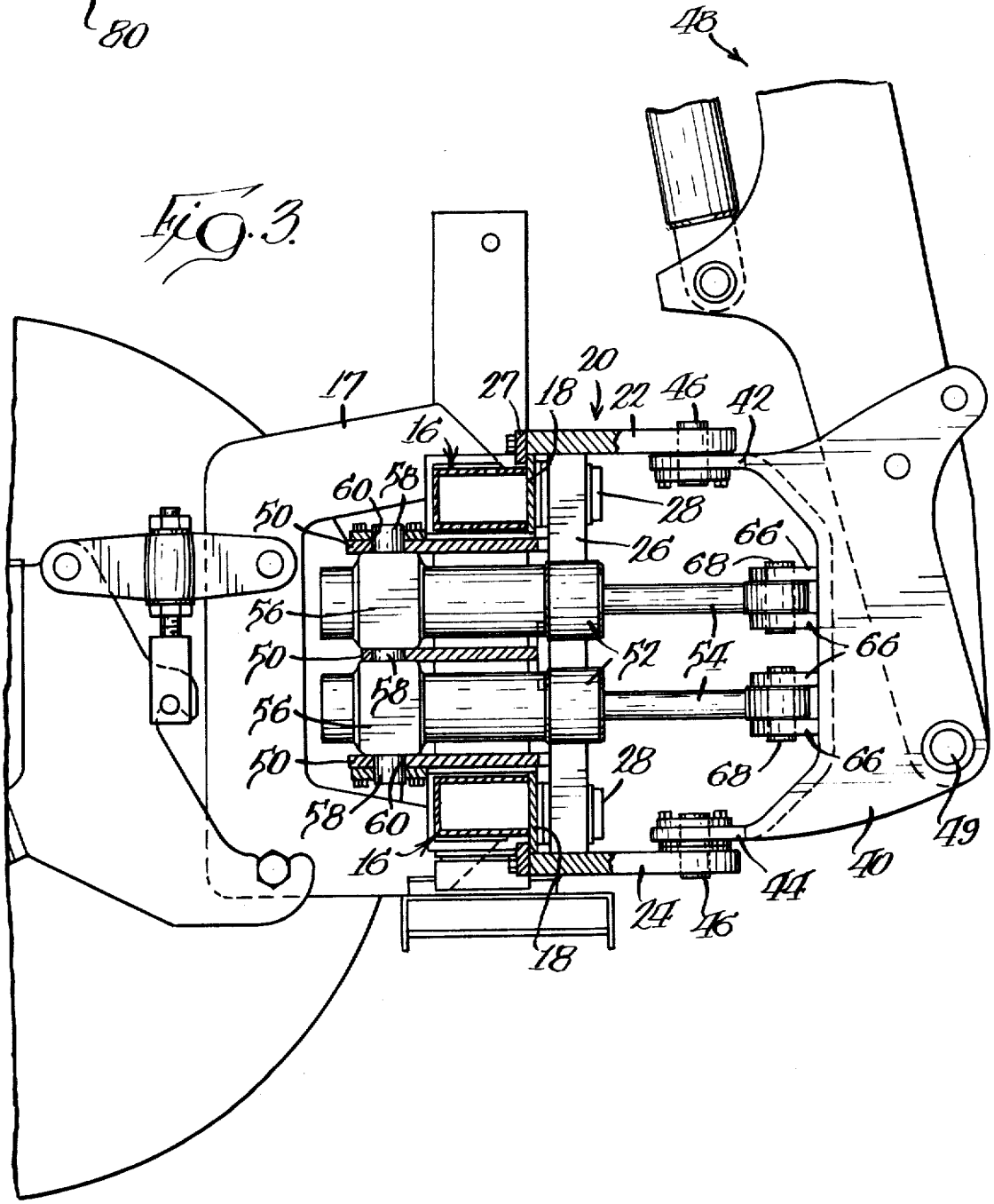
FIG. 3 is an enlarged vertical sectional view, as viewed along line 3—3 of FIG. 2.

Piston rods 54 of the respective fluid rams are respectively connected to an intermediate portion of swing tower 40. This connection consists of brackets 66 extending from the body of swing tower 40 with pins 68 extending through the apertures in the brackets and apertures in the end of piston rods 54. As shown in FIGS. 2 and 3, the respective piston rods are connected to the intermediate portion at laterally and vertically spaced points, both of which are spaced from the vertical pivot axis defined by pins 46.

Fluid under pressure is delivered to opposite ends of fluid rams in the same manner disclosed in Long U.S. Pat. No. 3,047,171, the portions of which are not inconsistent with this disclosure being incorporated herein by reference.

That is to say that the head end of one cylinder 52 is connected to the rod end of the other cylinder 52 by a conduit 70 while the rod end of the one cylinder 52 is connected to the head of the other cylinder by a conduit 72. Conduits 70 and 72 are connected to a three position valve 74 by conduits 76 and 78. Valve 72 may be of the type disclosed in the Long patent or any other type of three-way valve having pressure circuit relief valves therein to limit the pressure of the fluid in the high pressure circuits. Valve 74 is also connected to reservoir 80 through conduit 82 and to pump 84 by conduit 86.

The swinging of the swing tower is accomplished as explained in the Long patent. When valve 74, which is manually actuated, is positioned to connect pump 84 through conduit 86 to conduit 76, conduit 78 is connected to reservoir 80 through conduit 82, pressurized fluid is delivered to the head end of one cylinder and the rod end of the other cylinder. Assuming that the piston rods of the respective cylinders are on opposite sides of pivot axis 46, both fluid rams will be acting to swing tower 40 about pivot axis 46.

When the two piston rods are both on the same side of pivot axis 46 one fluid ram will be resisting swinging movement while the other cylinder will continue to produce swinging movement. Since the moment arm for the fluid ram resisting swinging movement is less than the moment arm of the other cylinder the swing tower will continue to rotate but the rotation will be checked, as explained in the Long patent. This condition will likewise occur when the swing tower is in an extreme position illustrated in FIG. 2 and is to be rotated clockwise. To accomplish this, pressurized fluid will be delivered to the head end of the lower cylinder and the rod end of the upper cylinder. It will be noted that, in this condition, the pressurized fluid is acting on the entire surface of the piston of the lower cylinder and a reduced surface on the piston of the upper cylinder (reduced by the diameter of the piston rod). This will further insure that the swing will be initiated even though one fluid ram is resisting such swinging movement.

As will be appreciated, the mounting of the fluid rams in the manner described above will locate the opposite or free ends of cylinders 52 forwardly of rails 16 so that the ends of the cylinders are located between the rear wheels of the vehicle.

The specific trunion mounting of the cylinders in the manner described above has a number of advantages. A primary advantage of the present arrangement is that the center of gravity for backhoe 48 is positioned substantially closer to the rear axle of the vehicle than was heretofore possible. It has been found that the counterweight normally associated with the front end of the vehicle can be eliminated or the weight thereof substantially reduced. Furthermore, the mounting of the cylinders on a common vertical pivot on the frame allows the swing tower frame to be moved in close proximity to either side of the vehicle or ends of the respective rails 16. This particular feature is of extreme importance in designing a commercially acceptable unit.

Another advantage of the trunion mounting of the cylinders in the manner described above is that it allows the manufacturer to substantially reduce the transverse dimension of the swing tower frame which allows the frame, particularly the center of the backhoe to be moved closer to either side of the vehicle. This allows the manufacturer to construct the frame much cheaper and the frame will be much more rigid. It has been determined that with the present arrangement described above, the swing tower frame 20 can be laterally shifted to a position that will place the center line of the backhoe assembly, defined by plane P less than two feet of a theoretical wall extending parallel to the outer edges of the wheels of the vehicle.

It has been found that the particular geometry for the connections of the cylinders and rods gives a more balanced ratio between speed and power for moving the swing tower.

A further advantage of mounting the cylinders in the manner disclosed herein is that the entire cylinders are totally protected by the rails as well as the plates which substantially reduces the possibility of damage resulting from material that might be dropped during the operation of the unit. Also, the piston rods for the respective fluid rams are likewise substantially protected by the upper and lower plates 22 and 24 as well as the upper and lower portions of the swing tower.

The positioning of the two cylinders in vertical alignment with each other and adjacent the vehicle substantially reduces the amount of conduct required and the conduits are protected by the vertically spaced plates.

Of course, it will be appreciated that trunion brackets 56 can be located at any position intermediate opposite ends of cyinders. For example, if trunion brackets were located adjacent the rod ends of cylinders 52, the spacing between the pivot means, defined by trunions 58, and pivot pins 68 would only have to be spaced from trunions 58 slightly more than the stroke of piston rods 54.

What is claimed is:

1. An earthworking implement including a vehicle having transversely spaced rear wheels, a pair of horizontally extending vertically spaced elongated slide rails fixed to said vehicle and located directly rearwardly of said rear wheels with the ends of said rails located behind said rear wheels, a side shiftable frame slidably supported on said rails and extending rearwardly, lock means on said frame for locking said frame on said rails, a swing tower having upper and lower portions pivotally mounted on said frame on a vertical pivot axis, a material handling unit supported on said swing tower, a pair of vertically aligned double acting fluid rams for pivoting said tower on said frame, each of said rams including a cylinder and a piston rod extending from one end thereof, said swing tower having first and second pins supported thereon and respectively spaced from said pivot axis with free ends of said piston rods respectively pivoted directly on the respective pins, said frame having a portion extending forwardly between said rails with said cylinders being located between said rails and supported on a common vertical pivot on a forward end of said portion so that opposite ends of said cylinders are located between said wheels so that said vertical pivot axis and said first and second pins are located in close proximity to said slide rails to position the center of gravity of said material handling unit close to said rear wheels, and means for simultaneously supplying fluid to both of said cylinders so that both cylinders act to pivot said tower during a major portion of the swing arc of said tower.

2. An earthworking implement as defined in claim 1, in which said portion includes lower, intermediate and upper vertically spaced plates and in which said cylinders each have trunions intermediate opposite ends, said cylinders being respectively located between adjacent pairs of plates with said trunions rotatable on respective plates, and in which a single trunion supports both cylinder on said intermedite plate.

3. An earthworking implement as defined in claim 1, in which said cylinders have trunions intermediate opposite ends and said trunions are supported on said common pivot axis.

* * * * *